US006786121B2

(12) United States Patent
Betti et al.

(10) Patent No.: US 6,786,121 B2
(45) Date of Patent: Sep. 7, 2004

(54) SEVERING MACHINE FOR ELONGATED ROLLS OF WEBLIKE MATERIAL HAVING MULTIPLE CUTTING BLADES

(75) Inventors: Giulio Betti, Lucca (IT); Angelo Benvenuti, Lucca (IT); Mario Gioni Chiocchetti, Lucca (IT)

(73) Assignee: Fabio Perini, S.p.A., Lucca (IT)

( * ) Notice: Subject to any disclaimer, the term of this patent is extended or adjusted under 35 U.S.C. 154(b) by 0 days.

(21) Appl. No.: 10/239,054

(22) PCT Filed: Mar. 23, 2001

(86) PCT No.: PCT/IT01/00142

§ 371 (c)(1),
(2), (4) Date: Sep. 19, 2002

(87) PCT Pub. No.: WO01/72482

PCT Pub. Date: Oct. 4, 2001

(65) Prior Publication Data

US 2003/0047054 A1 Mar. 13, 2003

(30) Foreign Application Priority Data

Mar. 28, 2000 (IT) ..... FI2000A0076

(51) Int. Cl.[7] ..... B26D 7/06
(52) U.S. Cl. ..... 83/411.6
(58) Field of Search ..... 83/411.3, 411.5, 83/411.6

(56) References Cited

U.S. PATENT DOCUMENTS

| | | | | | |
|---|---|---|---|---|---|
| 2,953,177 | A | * | 9/1960 | Galba | 83/411.6 |
| 3,122,043 | A | * | 2/1964 | Shanock et al. | 83/411.6 |
| 3,291,168 | A | * | 12/1966 | Zitner | 83/411.5 X |
| 3,757,622 | A | * | 9/1973 | Berry | 83/411.3 X |
| 3,797,338 | A | * | 3/1974 | Molnar | 83/411.6 X |
| 4,329,895 | A | | 5/1982 | Perini | |
| 4,651,790 | A | * | 3/1987 | Muller | 83/411.6 X |
| 5,357,833 | A | | 10/1994 | Biagiotti | |
| 5,522,292 | A | | 6/1996 | Biagiotti | |

FOREIGN PATENT DOCUMENTS

| | | |
|---|---|---|
| EP | 0 611 637 A1 | 8/1994 |
| IT | 1 103 635 | 10/1985 |

* cited by examiner

*Primary Examiner*—Charles Goodman
(74) *Attorney, Agent, or Firm*—Breiner & Breiner, L.L.C.

(57) ABSTRACT

The severing machine comprises, in combination: a series of cutting blades (23) rotating about respective axes; a feeder (111) rotating about an axis (111A) approximately parallel to the axis of the disk-shaped blades, having at least one peripheral seating (115A, 115B, 115C) for the products (L): a flexible member (201) passed around at least one portion of the periphery of the rotating feeder, in order to retain the products in the respective seating during cutting (FIG. 1).

7 Claims, 2 Drawing Sheets

151
153
L
115C
f111
225
111A
f209
209
201
111
115A
L
203
f201
23
31
13
35A
216
115B
217
213
207
205
201
227
215
f211
211
R
213
16A
16B
16C

SEVERING MACHINE FOR ELONGATED ROLLS OF WEBLIKE MATERIAL HAVING MULTIPLE CUTTING BLADES

DESCRIPTION

1. Technical Field

The present invention relates to a severing machine for cutting rolls or logs of great length into a plurality of small rolls intended for final consumption, or for cutting other elongate products, especially of weblike material, for example packs of paper napkins or other interleaved articles.

Machines of this type are commonly used in the paper converting industry for the production of rolls of toilet paper, rolls of kitchen paper and the like, or other paper articles.

2. State of the Art

In the paper converting industry, and especially in the production of products comprising tissue paper, provision is commonly made for the weblike material to be wound up into logs or rolls of large axial dimensions and diameter equal to the diameter of the finished article. These logs or rolls are subsequently cut into a plurality of small rolls, of axial dimensions equal to the final dimension of the article intended for consumption, by means of severing machines.

Typically, in order to perform the cutting of the rolls, use is made of severing machines which possess an assembly rotating or oscillating about a shaft and on which are mounted one or more disk-shaped blades rotating about their respective axes. The movement of the assembly brings the disk-shaped blade(s) mounted thereon to penetrate cyclically into the material forming the roll, which is caused to advance below the rotating assembly. At each cycle of the rotating assembly, at least one small roll is cut from one of the rolls being fed. Normally, a plurality of rolls are caused to advance in parallel and are cut simultaneously with successive passages of the same disk-shaped blade carried by the rotating or oscillating assembly. When the assembly carries two blades, two cuts are made during each cycle.

An example of a severing machine of this type is described in U.S. Pat. No. 5,522,292.

According to another known technology, provision is made to cut each roll into the final number of small rolls in a single pass by means of a series of parallel cutting blades. A severing machine of this type is described in U.S. Pat. No. 4,329,895. In this machine, the rolls to be cut are inserted into cradles which advance in a linear manner below a plurality of parallel rectilinear blades inclined relative to the direction of advance of the rolls. The blades all penetrate together and gradually into the material of the roll, cutting the latter into a series of small rolls during a single pass.

Another example of a severing machine which allows the simultaneous cutting of each roll into a plurality of small rolls is described in IT-B-1 103 635. In this known machine, a rotating assembly presents the individual rolls, which are accommodated in respective seatings, to a set of rotating blades. The rotating blades have a shape such as to penetrate gradually with their cutting edges into the thickness of the rolls.

These multiple severing machines are not sufficiently efficient to meet current high productivity requirements. At present, therefore, preference is given to systems which perform the cutting of the rolls in successive operations of "slicing" the rolls.

Moreover, the multiple-cutting machines known today are complex and bulky, and do not meet present-day safety standards.

OBJECTS AND SUMMARY OF THE INVENTION

It is an object of the present invention to provide a machine of the abovementioned type having multiple blades, with a new system for retaining the products to be cut, during cutting, which makes the machine efficient and structurally simple.

It is a further object of the present invention to provide an improved severing machine having multiple blades for the simultaneous cutting of a series of small rolls from rolls or logs of wound-up weblike material or for the cutting of other articles from elongate products, which is of simple and compact construction.

These and other objects and advantages, which will become apparent to those skilled in the art from reading the text that follows, are substantially achieved with a severing machine for elongate products, comprising, in combination:

- a series of cutting blades rotating about respective axes of rotation;
- a feeder rotating about an axis approximately parallel to the axes of the disk-shaped blades, having at least one peripheral seating for said products, which removes said products from a removal zone and transfers them to said blades for cutting;
- a flexible member passed around at least one portion of the periphery of the rotating feeder, in order to retain the products in said at least one seating during cutting.

The rotating feeder comprises, preferably, more than one seating, more rapid operation thus being obtained. The cutting blades are, according to the preferred embodiment of the invention, disk-shaped blades, in other words having a circular cutting edge, although this is not strictly necessary. They could, for example, have a cutting edge in the form of a portion of a helix.

According to a possible embodiment of the invention, the flexible member comprises at least one continuous belt, passed around at least two return pulleys and, along a section between said two pulleys, around a portion of the peripheral development of the rotating feeder, said rotating feeder having an approximately cylindrical lateral surface along which opens said at least one seating for the products to be cut.

Further advantageous embodiments of the severing machine according to the invention are indicated in the attached dependent claims.

BRIEF DESCRIPTION OF THE DRAWINGS

The invention will be better understood with reference to the description and the attached drawing, which shows a practical non-limiting embodiment of the invention applied to a severing machine for rolls or logs of weblike material. More specifically, in the drawing.

DETAILED DESCRIPTION OF THE PREFERRED EMBODIMENT OF THE INVENTION

Figure 1:
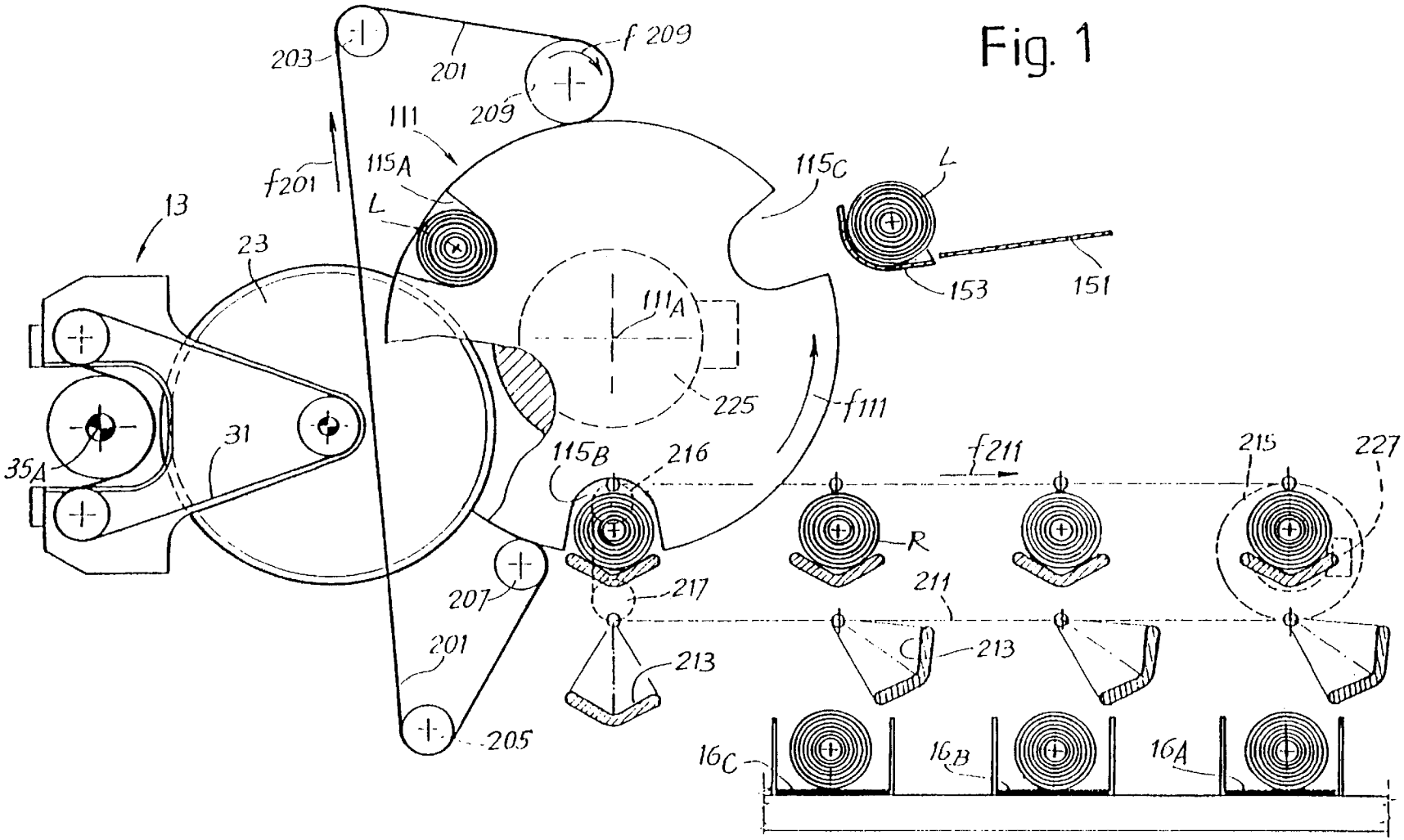
FIG. 1 shows a lateral view of the severing machine.
Figure 2:
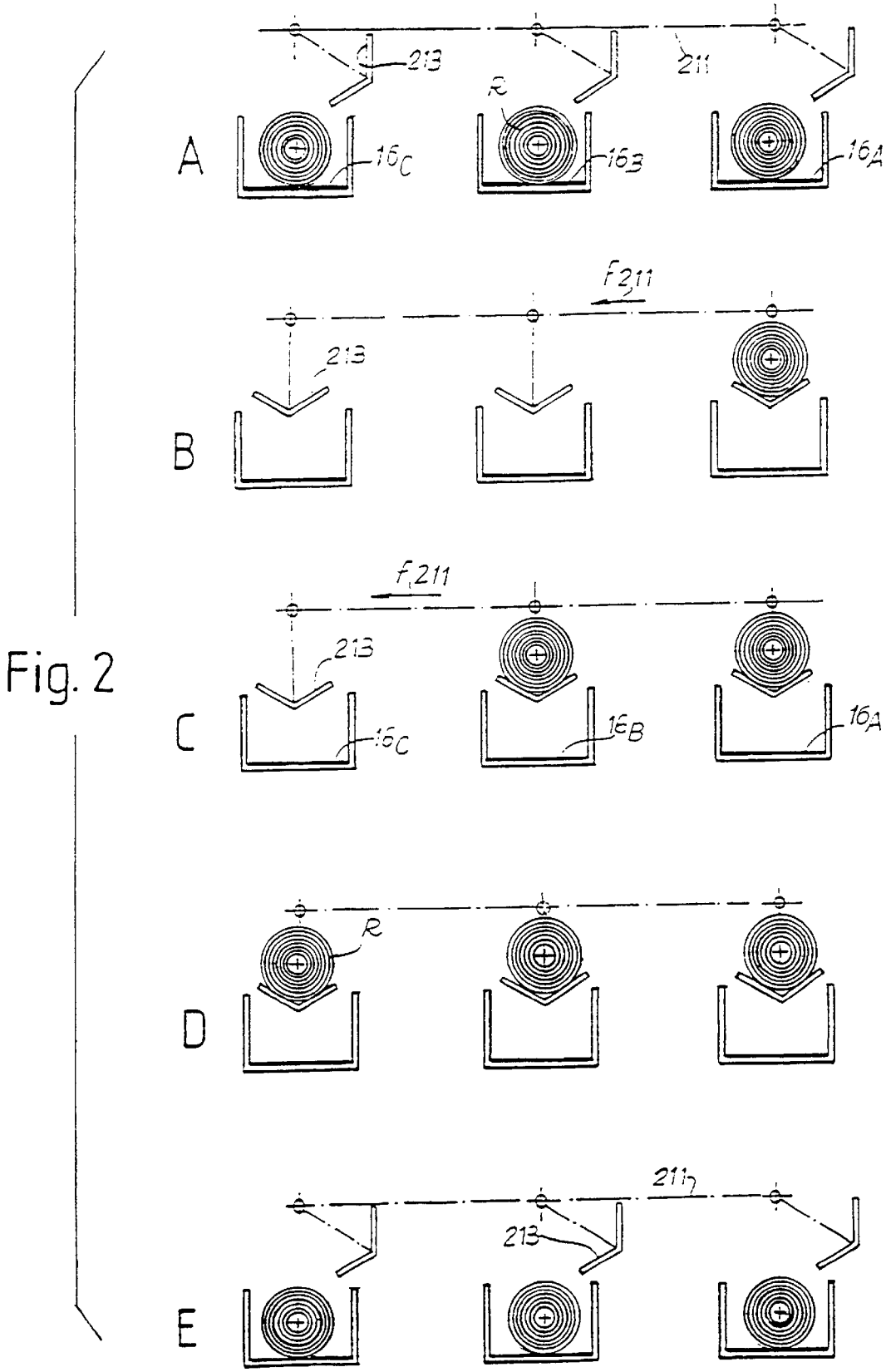
FIGS. 2A–2E show successive phases of the release of the cut small rolls into the unloading channels.

The severing machine possesses (FIG. 1) a cutting unit 13 having a series of disk-shaped blades 23, rotating about a common axis (or, possibly, about respect axes which are not aligned but are approximately mutually parallel), driven, by means of belts 31, by a motor shaft 35A. FIG. 1 shows a lateral view wherein only one of the rotating disk-shaped blades 23 can be seen, the others being masked and not visible. In practice, along the axis of rotation, which extends orthogonally to the plane of the figure, rotating disk-shaped cutting blades are arranged in a sufficient number to subdivide each roll into the desired number of small rolls and to cut off the head and tail trimmings of the roll. The cutting unit may also comprise a plurality of series of cutting blades that can be employed in alternation.

The rolls or logs L coming from a storage unit (not shown), or from another feed system, are taken from a rotating feeder 111, which rotates—with continuous or intermittent motion—about a horizontal axis 111A. The rotating feeder 111 has a cylindrical development, along which are formed three seatings 115A, 115B and 115C, which can be adapted if necessary—with inserts or the like—to the diameter of the rolls. Each seating 115A, 115B and 115C receives the rolls or logs L from a rotating or oscillating distributor 153 which takes them from a chute 151 associated with the storage unit. The feeder also possesses annular grooves for the passage of the blades, visible in the zone shown in section.

The rotating feeder 111 is encompassed, over an appropriate arc and on the side facing the cutting unit 13, by a plurality of belts or equivalent continuous flexible members, designated 201. Only one of said belts is visible in FIG. 1, the others being arranged along the same path and therefore behind that shown in FIG. 1, at appropriate distances so as not to interfere with the cutting blades.

The belts 201 are passed around wheels or pulleys 203, 205, 207 and 209 with fixed axes. The retaining member formed by the belts 201 is therefore fixed relative to the rotating feeder 111, in the sense that the latter remains in the same spatial position, although moving along the transmission path defined by the pulleys and the rotating assembly.

As is clearly apparent in the drawing, the belts 201 constitute a retention system which retains each roll L fed by the rotating feeder 111 to the cutting unit 13 for the entire period necessary to perform the cutting of the rolls L into small rolls R and until the unloading position is reached.

Arranged below the rotating feeder 111, in the example shown, is a flexible member 211 which bears a plurality of oscillating cradles 213 which are movable along the closed path defined by said flexible member 211, passed around wheels 215, 216 and 217. Below the system of mobile oscillating cradles 213 are arranged three unloading channels 16A, 16B and 16C, equipped with respective outward conveyor belts.

With this configuration, as will be clarified below, the small rolls transported by the rotating feeder 111 are released after cutting to the oscillating cradles 213 and released from there in threes into the three unloading channels 16A, 16B and 16C, so that the conveyor belts within the latter can move at a speed one third of that which would be necessary to remove all the small rolls if the latter were unloaded into a common channel.

FIGS. 2A through 2E show the sequence for releasing the rolls from the rotating feeder into the unloading channels in a possible form of embodiment. As is apparent by comparing the sequence of positions shown in FIG. 2, the rotating feeder 111 unloads the various series of cut small rolls R successively into the various cradles 213. The latter are caused to advance stepwise in a manner such as to present an empty cradle on each occasion below the seating 115A, 115B or 115C. The cradles 213, in other words those that contain the cut small rolls R, are transferred stepwise from the upper strand of the flexible member 211 to the lower strand thereof, in alignment with the unloading channels 16A, 16B and 16C. Once three cradles 213 are located above the three unloading channels 16A, 16B and 16C, the latter are simultaneously caused to oscillate in order to release the three series of small rolls R into the unloading channels 16A, 16B and 16C, where the respective conveyor belts remove said small rolls in a direction orthogonal to the plane of the figure.

It will be understood that the movements of the cradles 213, of the flexible member 211 and of the rotating feeder 111 can also be differently phased, the distances between the cradles 213 on the flexible member 211 being modified as appropriate.

In the example shown, the rotating feeder 111 is caused to rotate by a motor 225 and transmits the motion to the belts 201, which may or may not be toothed, in order to interact with a corresponding peripheral toothing of the feeder 111. A second motor 227 supplies the motion to the wheel 215 and thence to the flexible member 211. The two motors 225 and 227 are synchronized with one another in order to obtain the correct transfer of the rolls, for example by means of an electronic control. The possibility of a mechanical connection, for example by means of an intermitter or a mixed linkage, for example using epicycloidal gears and correcting motors, is not ruled out.

It is understood that the drawing shows only a simplification, provided solely by way of a practical demonstration of the invention, the latter being capable of being varied in shapes and arrangements without thereby departing from the scope of the idea underlying said invention.

What is claimed is:

1. A severing machine for simultaneously cutting elongate products into series of articles, comprising, in combination:

a series of cutting blades rotating about respective axes;

a feeder rotating about an axis approximately parallel to the axis of the cutting blades, having at least one peripheral seating for receiving and holding said products during cutting through said products by said series of cutting blades to provide said series of articles, said cutting blades being constructed and arranged to cut through said products while positioned in said at least one peripheral seating, said feeder removing said products from a removal zone and transferring said products to said blades for cutting;

a flexible member passed around at least one portion of the periphery of the rotating feeder, in order to retain the products in said at least one seating during cutting.

2. Severing machine as claimed in claim 1, wherein said rotating feeder possesses a plurality of seatings for said products.

3. Severing machine as claimed in claim 1 or 2, wherein said cutting blades are disk-shaped blades.

4. Severing machine as claimed in claim 1 or 2, wherein said flexible member comprises at least one continuous belt, passed around at least two return pulleys and, along a section between said two pulleys, around a portion of the periphery of the rotating feeder, said rotating feeder having an approximately cylindrical lateral surface along which opens said at least one seating for the products to be cut.

5. Severing machine as claimed in claim 1 or 2, wherein at least one unloading channel for cut articles is disposed downstream of the flexible member, relative to the direction of rotation of the rotating feeder.

6. Severing machine as claimed in claim 5, wherein a loading zone for the products to be cut is arranged upstream of the flexible member, relative to the direction of rotation of said rotating feeder.

7. Severing machine as claimed in claim 1 or 2, wherein the axis of rotation of said rotating feeder is horizontal.

* * * * *